United States Patent [19]

Nagy et al.

[11] 4,057,900

[45] Nov. 15, 1977

[54] POWER SAW

[75] Inventors: György Nagy, Molndal; Bengt Olof Johan Stellan Mörner, Hovas, both of Sweden

[73] Assignee: AB Partner, Sweden

[21] Appl. No.: 689,923

[22] Filed: May 25, 1976

[30] Foreign Application Priority Data

June 4, 1975 Sweden ..... 7506347

[51] Int. Cl.[2] ..... B27G 19/06; B27B 17/02

[52] U.S. Cl. ..... 30/382; 188/166

[58] Field of Search ..... 30/381, 382, 383, 384, 30/385, 386; 188/77 W, 166

[56] References Cited

U.S. PATENT DOCUMENTS

| | | | |
|---|---|---|---|
| 3,739,475 | 6/1973 | Moore | 30/383 |
| 3,776,331 | 12/1973 | Gustafsson | 30/381 |
| 3,810,309 | 5/1974 | Wiklund | 30/382 |
| 3,937,306 | 2/1976 | Naslund | 30/383 |

*Primary Examiner*—Jimmy C. Peters

*Attorney, Agent, or Firm*—Hill, Gross, Simpson, Van Santen, Steadman, Chiara & Simpson

[57] ABSTRACT

In power saws of the kind comprising a cutter bar around which travels a motor-driven saw chain, a safety device arranged to ensure automatic release of a safety brake to stop the saw chain. The device comprises a two-arm lever which is pivotally mounted in the body of the saw in such a manner that one arm abuts against the cutter bar so as to transmit jerky movements of said bar to the opposite arm which cooperates with means on a pivotable plate to influence the braking means.

9 Claims, 5 Drawing Figures

POWER SAW

BACKGROUND OF THE INVENTION

The present invention concerns an arrangement in a power saw to automatically release a safety brake which is arranged to stop the saw chain travelling around the cutter bar of the power saw.

When working with chain power saws it is possible to have the outer tip of the saw chain accidentally come into contact with a tree trunk or similar object, resulting in unexpected jerky movements of the saw. This is a well recognized risk, and to reduce the chance of bodily harm to the saw operator, a safety brake is normally arranged in the saw in such a manner as to become immediately operative upon occurrence of such jerky movements of the cutter bar.

Usually, the brake consists of a belt travelling around a drum and connected to a pre-tensioned spring via a blocking mechanism. In addition, a protective yoke is provided in front of one of the handles of the power saw and connected with said blocking mechanism. When jerky movements occur that are so strong that the operator loses his grip on the saw handle and his arm strikes the protective yoke, the latter triggers the brake to stop the power saw chain.

A power saw constructed in this manner is not, however, completely satisfactory from a safety point of view because to trigger the brake it is necessary that the saw operator somehow engage the protective yoke. This is not always the case. Should the saw operator, despite a heavy jerk of the cutter bar, be able to retain his grip on the handle, the cutter bar may instead hit a person standing beside the operator. A jerky movement may also occur when the saw is in felling position, in which case one of the operator's hands is not positioned between the protective yoke and the handle.

One way of eliminating the above problem is to make use of the relative movement between the handle, yoke and the body of the saw that is possible in power saws built with a vibration-dampening member. On account of the relative movement which arises at the occurrence of a strong jerky movement, the brake mechanism may be triggered off via actuating means of some kind. Triggering mechanisms built on this principle are not, however, completely reliable because the vibration-dampening members which consist of blocks or insets of rubber generate relative movements of varying amplitude depending on the surrounding temperature. Should the temperature decrease radically from one day to the next the modulus of elasticity of the members will also change excessively, which may lead to non-actuation of the brake at the occurrence of jerky movement.

In accordance with another technique which eliminates the need for displacement of the protective yoke to stop a jerky movement, the cutter bar is arranged to perform a short pivotal movement relative to the body of the saw. In addition, the cutter bar is connected to a spring means which upon a jerky movement of the cutter bar dampens this movement and thus enables the saw operator to retain his grip on the power saw. However, this device does not bring the saw chain to a standstill. If it were combined with a brake of the kind outlined above, the spring means would to some extent counteract and thus delay the triggering of the brake.

SUMMARY OF THE INVENTION

It is a principle object of the present invention to provide an improved braking means for a power chain saw.

It is another object of the present invention to provide braking means for a power chain saw which is responsive to pivotal movement at the cutter bar in its mounting.

It is another feature of the present invention to provide a power chain saw having a cutter bar which is arranged for short pivotal movements upward from its normal position and which pivotal movements are used to trigger a rapid brake mechanism.

It is also a feature of the present invention to provide a lever arm connected at one end to the cutter bar and responsive to pivotal movement of the cutter bar and connected at the other end to a protective yoke for holding the saw in a non-braking position.

The present invention provides a device for automatically releasing a blocking mechanism for a safety brake in power chain saws which device is based on the above principle of cutter bars capable of performing a short pivotal movement upwards from their normal position relative to the body of the saw. The device in accordance with the invention is characterized by a lever which is pivotally mounted in the body of the saw and which by means of a point of contact cooperates with the blocking mechanism and by means of a second point of contact is connected to the cutter bar, the latter being arranged upon its movement upwards relative to the body of the saw to actuate said lever to effect triggering of the blocking mechanism so as to release the braking force.

Because the angle through which the cutter bar may pivot is very short and the consequential short time interval between the occurrence of the release force at the tip of the cutter bar and the triggering of the force which brakes the rotating members (cranking, flywheel, transmission), the reactional momentum thereof prevents the cutter bar tip from receding from, or substantially receding from the object of impact before the saw chain has come to a standstill. Consequently, the device in accordance with the invention will, following a jerky movement of the cutter bar, bring about an immediate stop of the motor and thus of the saw chain. Owing to the rapidity with which the device becomes operative and the efficiency thereof in all positions, i.e. independent on whether the jerky movements occur in the horizontal or vertical direction, the device in accordance with the subject invention provides the saw operator with a completely reliable safety brake.

Further characteristics and advantages to be gained by the invention will become apparent upon reading of the following detailed description of a preferred embodiment.

DESCRIPTION OF THE PREFERRED EMBODIMENT

Figure 1:
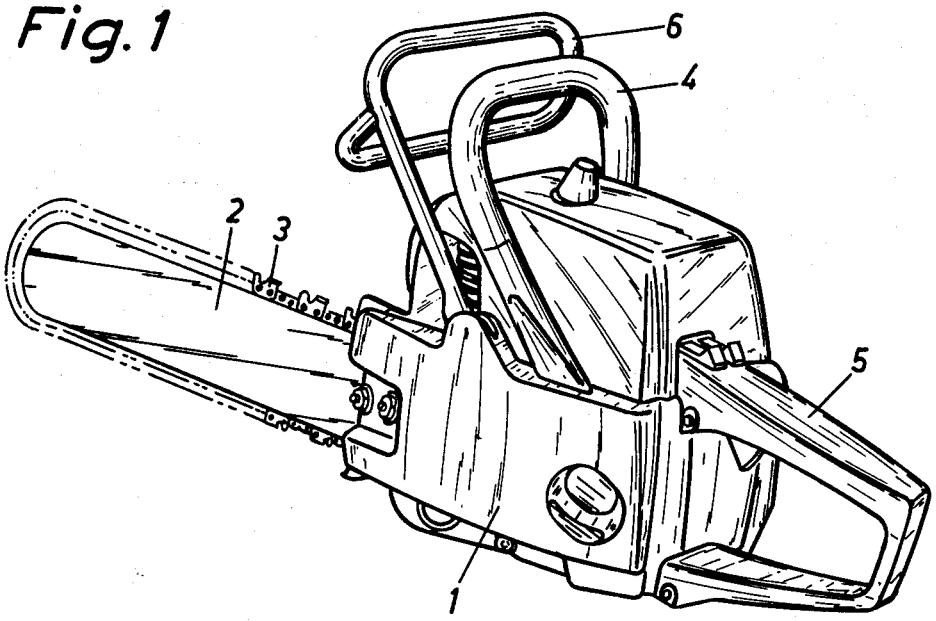
FIG. 1 is a perspective view of a power chain saw.

In FIG. 1 a power saw comprises a body 1 and a cutter bar 2 projecting from the body around which travels a saw chain 3, only schematically indicated in the drawings. The body 1 supports a forward handle 4 and a rear handle 5. In front of the forward handle a protective yoke 6 is provided, the purpose of which is to prevent the hand of the saw operator, should he lose his grip on the handle 4, from coming into contact with the saw chain 3.

Figure 2:
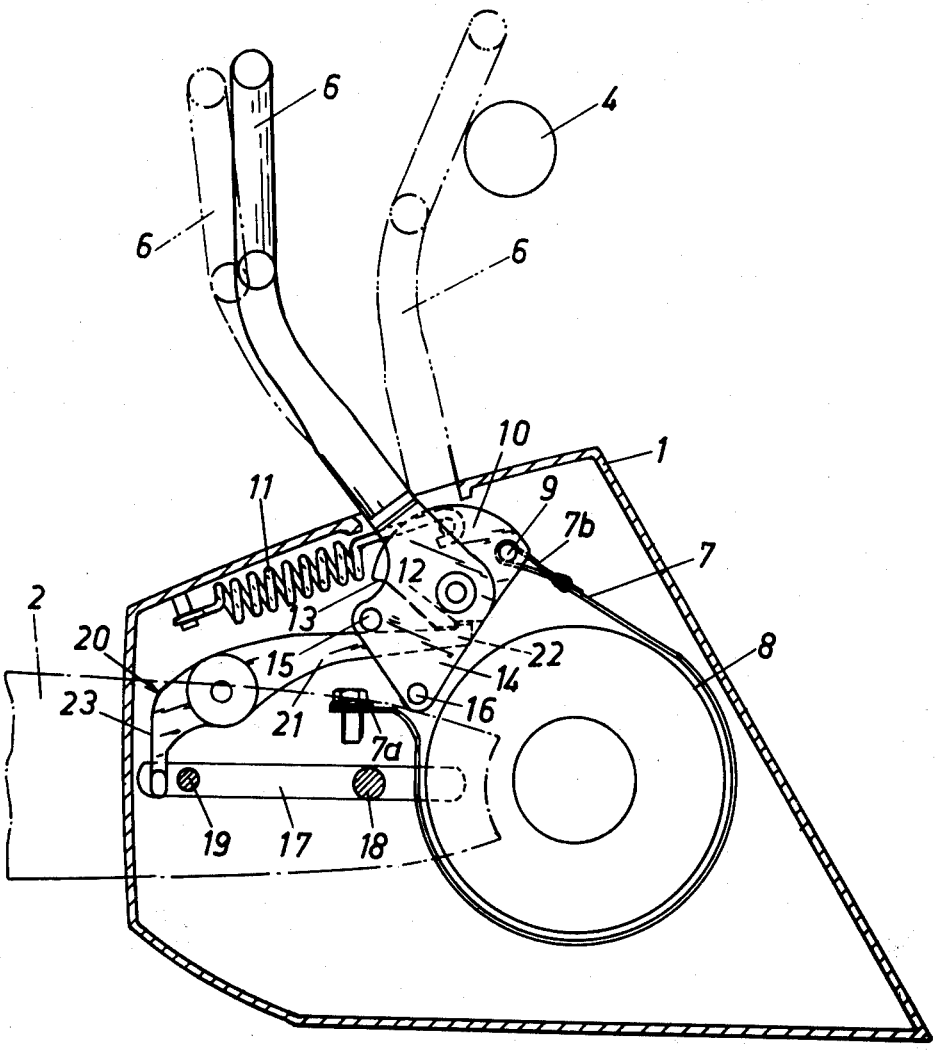
FIG. 2 is a side view which on an enlarged scale illustrates the system of the invention in cooperation with a brake of prior-art structure.

As appears from FIG. 2, a brake is provided on the saw body 1, said brake being of a kind known per se and consisting of a belt 7 travelling around a drum 8 which may be e.g. the ordinary transmission drum. The belt 7 has one end *7a* secured to the saw body 1 and its opposite end *7b* secured to a pin 9 arranged on a rotary segmental plate 10. In the same manner, a spring means 11 is held between the saw body 1 and the segmental plate 10, said spring means tending to bring the braking belt 7 into a position of engagement around the drum 8.

The rotary plate 10 is provided with a blocking shoulder 12 and an actuating shoulder 13 located between the latter and the spring attachment point on the plate 10.

An actuating plate 14 is arranged for pivotal movement coaxially with the segmental plate 10 and is provided with a first follower means 15 and a second follower means 16.

The cutter bar 2 is secured to the body 1 by means of two bolt joints. The bolts of these bolt joints extend through a slit 17 formed in the cutter bar. The inner bolt 18 has a diameter which essentially agrees with the width of the slit whereas the outer bolt 19 has a reduced diameter compared thereto. The bolt joints do not include the friction linings illustrated in the drawings. On account of the arrangement described, the cutter bar 2 is capable of performing a limited swinging movement in its own plane about the inner bolt 18 subject to a certain inertia.

The embodiment illustrated in the drawings includes a two-arm lever 20 which is journalled in the saw body 1. One arm 21 thereof supports at its outer end a blocking edge 22 arranged for cooperation with the blocking shoulder 12 formed on the segmental plate 10. The opposite arm 23 of the two-arm lever 20 abuts with its outer end against the lower edge of the slit 17 formed in the cutter bar 2.

Figure 3:
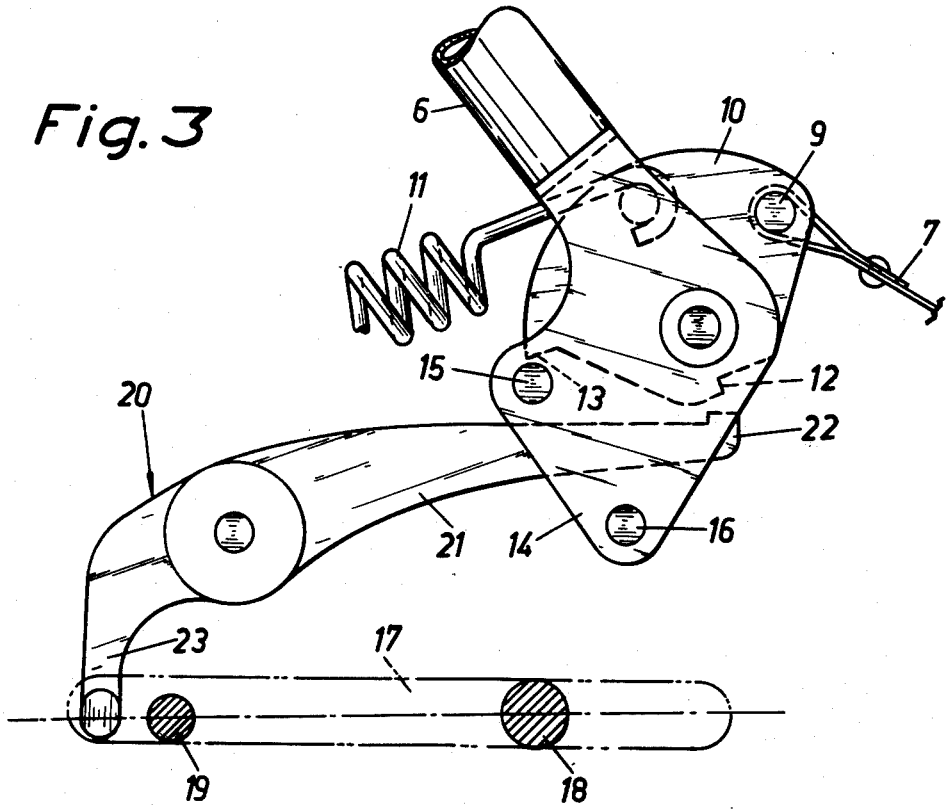
FIGS. 3 through 5 illustrate a section of the saw of the present invention in various positions.

FIG. 2 illustrates the positions when the arm 21 of the lever 20 engages the rotary segmental plate 10, the spring means 11 is tensioned, and the drum 8 travels freely internally of the braking belt 7. Should the power saw perform a jerky movement, the cutter bar 2 will be thrown upwards relative to the saw body 1 until the lower edge of the slit 17 moves into abutment against the bolt 19. This forces the lever 20 to rotate sufficiently for the blocking edge 22 to disengage itself from the blocking shoulder 12 (see FIG. 3). The pre-tensioned spring means 11 will then, via the rotary segmental plate 10, pull the braking belt 7 into braking position about the drum 8, and the engine will stop immediately.

Figure 4:
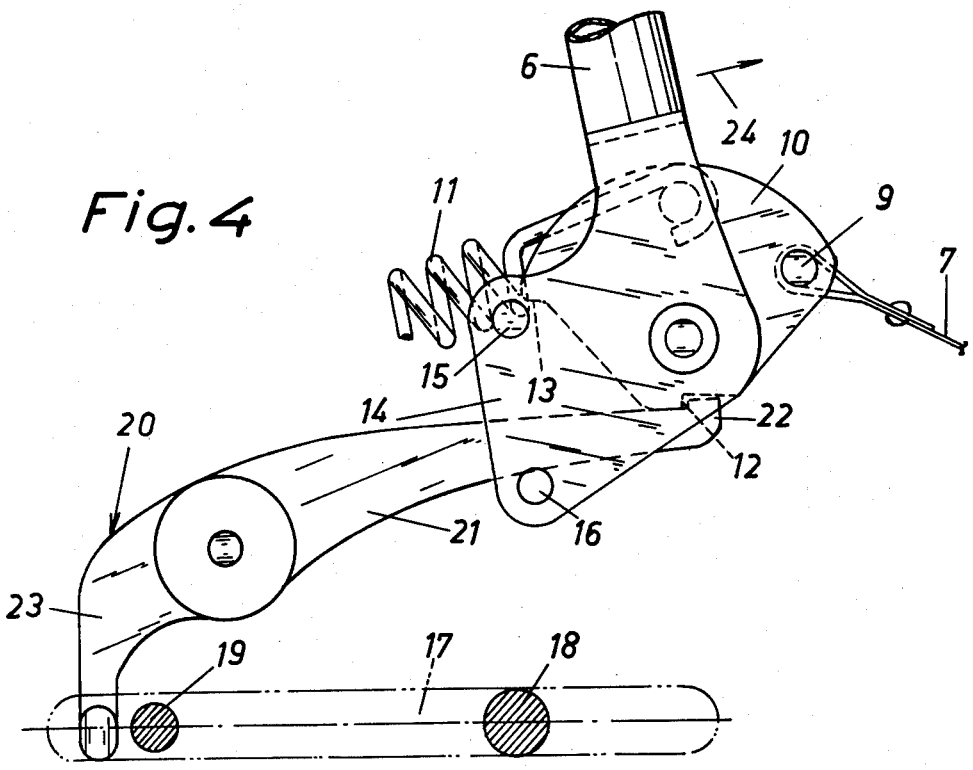

In the embodiment illustrated in the drawings, the actuating plate 14 is connected with the protective yoke 6. FIG. 4 shows the manner in which the latter is used in assisting to reset the blocking mechanism. When the protective yoke 6 is moved in the direction illustrated by arrow 24, the actuating plate 14 is turned clockwise. As a result, the follower means 15, which may consist of a pin projecting from the actuating plate 14, moves into abutment against the shoulder 13, carrying along the rotary segmental plate 10, whereby the spring means 11 is tensioned and the braking belt 7 is slackened. Simultaneously, the follower means 16 which similarly may be in the form of a pin, moves into abutment against the lower face of the lever arm 21 so as to turn the lever 20 anticlockwise, whereby the lever arm 23 forces the cutter bar 2 downwards, back to the normal position of the bar. When the yoke 6 has been moved sufficiently far for the blocking shoulder 12 to move past the blocking edge 22, it is possible to let the bar move slightly backwards, whereby the shoulder 12 and the edge 22 again engage. It is now possible to restart the motor.

Figure 5:
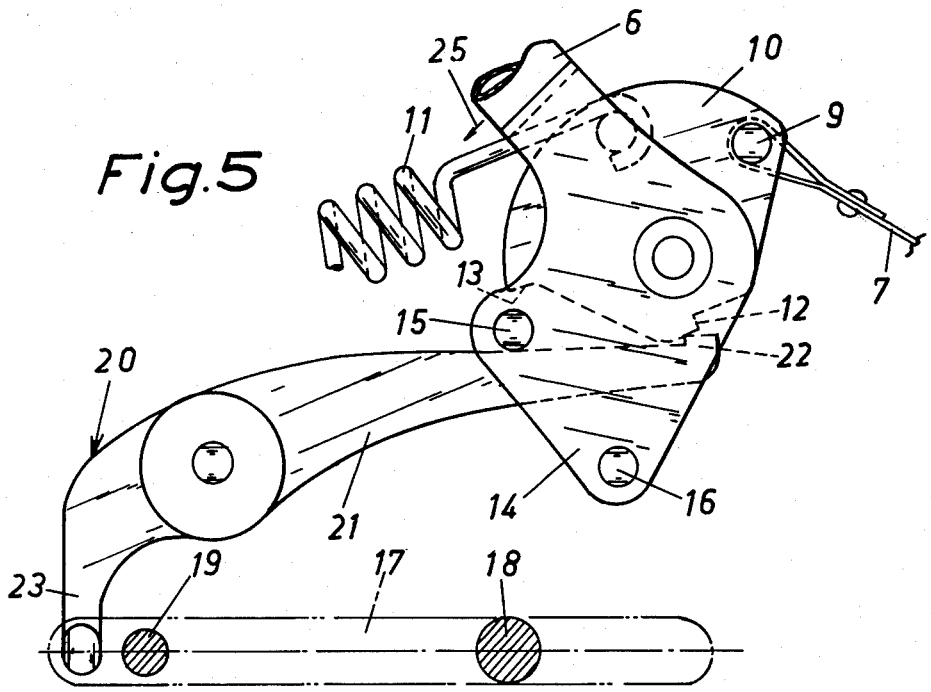

FIG. 5 illustrates the manner in which the apparatus works in connection with conventional triggering of the brake by means of the protective yoke 6. When the latter is pushed in the direction indicated by arrow 25, the follower means 15 will exert a pressure on the upper face of the lever arm 21 so as to unlock the blocking mechanism, whereby the spring 11 pulls the braking belt 7 into braking position. To return the mechanism to the blocking position, the yoke 6 is pulled in the opposite direction, as described above. In this case, the follower means 16 need not, however, move into abutment against the lower face of the lever arm 21. It may, however, be preferable that the lever 20 is actuated by a spring, not shown, such as e.g. a watch spring ensuring the engagement of the edge 22 with the shoulder 12.

The invention is not limited to the embodiment described and illustrated but may be modified in a variety of ways within the scope of the appended claims. In accordance with a preferred modification, the rotary segmental plate 10 consists of two parallel plates, the attachment means securing the braking belt 7 and the spring means 11 extending between these two plates. In addition, the protective yoke 6 is connected to two actuating plates 14, one arranged at either side of the two rotary segmental plates, with the arm 21 of the lever 20 extending between the two plates 14.

In accordance with a further embodiment, the cutter bar 2 may be secured to a plate which is rotationally mounted relative to the saw body 1 and to which plate the mechanism in accordance with the invention is coupled. This arrangement makes it possible to mount the cutter bar in a more secure and stable manner.

Furthermore, it is not either necessary to use a two-arm lever 20 for the transmission of the pivotal movement of the cutter bar 2. Instead, a push bar or similar means may serve for this purpose, forming a direct connection means between the cutter bar and the blocking mechanism 10, 13.

What we claim is:

1. A power chain saw comprising:

a power housing and a longitudinal cutter bar extending forwardly from one side of the housing, said cutter bar being mounted in said power housing in a manner to permit it to have short pivotal movements upwardly relative to said power housing, a chain disposed circumferentially about said cutter bar and carrying cutting members and being driven by a motor drive and an associated drive shaft means located within said power housing, a least one grip handle extending across the top of the housing between the operator and the longitudinally extending cutter bar, a strike bar having a portion extending transversely to said cutter bar and being positioned forwardly of and generally parallel to said grip handle, said strike bar being carried on a shaft journaled within said housing to be pivotable between a forward braking position and a rearward non-braking position, a brake means engageable with said drive shaft means for substantially simultaneously stopping the drive shaft means and the chain, a spring loaded trigger action braking mechanism of which a portion is operatively coupled to the brake means for urging the same to a braking state upon being triggered, triggering means connected to the strike bar and releasably engageable with said spring loaded trigger action mechanism, which normally hold said mechanism in a position in which the brake is a non-braking state, to release said spring loaded trigger action mechanism to said braking state when the strike bar is struck and pivoted forwardly by the hand of the saw operator at an occasional flinging movement of the saw, and means automatically restoring said triggering means to said non-braking state by rearward pivotal movement of said strike bar shaft and a force transmitting means coupled to said cutter bar to respond to short pivotal movements thereof and being operatively associated with said spring loaded trigger action mechanism for triggering the same in response to said short pivotal movements of said cutter bar.

2. A power chain saw in accordance with claim 1 wherein said strike bar has a support arm extending from a pivot point at the saw housing and wherein said triggering means comprises a projection formed integrally with and in the vicinity of the pivoted end of said support arm.

3. A power chain saw in accordance with claim 1 wherein two longitudinally spaced apart mounting means are provided to mount the cutter bar to the power housing, the second mounting means being located outboard of and providing substantially more free play than the first mounting means whereby the cutter bar may be pivoted through a restricted angle with respect to said first mounting means.

4. In a power saw having a cutter bar, a saw chain mounted to travel around said cutter bar and a safety brake for stopping the saw chain, an improved device to provide for automatic release of said safety brake comprising:

a blocking mechanism for holding said braking means in a non-braking position, said cutter bar being mounted in the saw in a manner to permit short pivotal movements upwards from its normal position relative to the body of said saw, and mechanical release means mounted in the saw and coupled to the cutter bar to receive a force transmission from an upward pivotal movement of the cutter bar, and having a segment thereof responsive to said force transmission to release the said blocking mechanism and cause said brake to be actuated.

5. A power saw in accordance with claim 4 wherein said release means comprises a lever pivotally mounted in the power housing and having two arms extending oppositely of its pivot point, one arm being in force transmitting relation with the cutter bar and the other arm being in a force transmitting relation with the blocking mechanism, whereby movement of the cutter bar may transmit a force to move the first arm and hence the second arm to transmit a force for releasing the blocking mechanism.

6. An improved device in accordance with claim 5 wherein said blocking mechanism comprises a rotary segmental plate mounted in the power housing, said braking means being triggered by rotary movement of said rotary segmental plate, a blocking shoulder formed on said rotary segmental plate, said second lever arm normally engaging said blocking shoulder, and holding said brake in a non-braking position.

7. An improved device in accordance with claim 6 wherein said actuating plate is arranged for pivotal movement coaxially with said rotary segmental plate, said rotary segmental plate having a catch surface, a first follower means formed on said actuating plate and being arranged to cooperate with said catch surface on said rotary segmental plate to rotate the same in a manner to effect blocking re-engagement between said rotary segmental plate and said second lever arm.

8. An improved device in accordance with claim 7 wherein a second follower means is formed on said actuating plate, said second follower means being positioned to assist re-engagement of said second lever arm with said blocking mechanism by urging said second lever arm into locking position with said rotary segmental plate and, via said pivot point, forcing said first lever arm to return said cutter bar to its normal position.

9. An improved device according to claim 7 comprising a protective yoke provided externally of the body of said saw, said actuating plate being connected to said protective yoke, said protective yoke being movable in a direction toward said cutter bar to force said first follower means of said actuating plate to press said second lever arm out of its blocking engagement with said rotary segmental plate, and thereby actuating said safety brake.

* * * * *